US009771856B2

(12) United States Patent
Nakao

(10) Patent No.: US 9,771,856 B2
(45) Date of Patent: Sep. 26, 2017

(54) CENTRIFUGAL COMPRESSOR

(71) Applicant: TOYOTA JIDOSHA KABUSHIKI KAISHA, Toyota-shi, Aichi-ken (JP)

(72) Inventor: Hidefumi Nakao, Yokohama (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 71 days.

(21) Appl. No.: 14/797,446

(22) Filed: Jul. 13, 2015

(65) Prior Publication Data

US 2016/0017791 A1 Jan. 21, 2016

(30) Foreign Application Priority Data

Jul. 16, 2014 (JP) ..... 2014-146093
Apr. 7, 2015 (JP) ..... 2015-078575

(51) Int. Cl.
*F02B 33/40* (2006.01)
*F04D 17/10* (2006.01)
(Continued)

(52) U.S. Cl.
CPC ..... *F02B 33/40* (2013.01); *F04D 17/10* (2013.01); *F04D 25/02* (2013.01);
(Continued)

(58) Field of Classification Search
CPC ..... F04D 17/10; F04D 25/02; F04D 27/0207; F04D 29/685; F04D 29/284;
(Continued)

(56) References Cited

U.S. PATENT DOCUMENTS 7,775,759 B2 * 8/2010 Sirakov ..... F04D 29/4213 415/1
8,272,832 B2 * 9/2012 Yin ..... F04D 29/444 415/191

(Continued)

FOREIGN PATENT DOCUMENTS

CN 101560987 A 10/2009
DE 198 23 274 C1 10/1999

(Continued)

OTHER PUBLICATIONS

Machine Translation of JP 2012149619 A.*

*Primary Examiner* — Nathaniel Wiehe
*Assistant Examiner* — Elton Wong
(74) *Attorney, Agent, or Firm* — Finnegan, Henderson, Farabow, Garrett & Dunner, LLP

(57) ABSTRACT

A centrifugal compressor having a casing that houses an impeller allowing rotation about a rotational axis C, a gas channel, a treatment hollow part provided inside the casing, a first channel open to the gas channel on the downstream side of the blade leading edge of the impeller, a second channel open to the gas channel at the upstream side of the blade leading edge, a guide vane that imparts a swirl component in an opposite rotational direction of the impeller to gas discharged from the second channel, a constricting part that constricts the gas channel, and a rectifying part that rectifies gas in a direction that minimizes the swirl component about the rotational axis C and also increases the component in the direction of the rotational axis C.

8 Claims, 16 Drawing Sheets

(51) Int. Cl.

| | |
|---|---|
| ***F04D 25/02*** | (2006.01) |
| ***F04D 27/02*** | (2006.01) |
| ***F04D 29/28*** | (2006.01) |
| ***F04D 29/42*** | (2006.01) |
| ***F04D 29/68*** | (2006.01) |
| ***F04D 29/44*** | (2006.01) |

(52) U.S. Cl.
CPC ..... *F04D 27/0207* (2013.01); *F04D 29/284* (2013.01); *F04D 29/4206* (2013.01); *F04D 29/4213* (2013.01); *F04D 29/444* (2013.01); *F04D 29/685* (2013.01)

(58) Field of Classification Search
CPC ..... F04D 29/4206; F04D 29/4213; F04D 29/444; F02B 33/40
See application file for complete search history.

(56) References Cited

U.S. PATENT DOCUMENTS

2004/0009061 A1* 1/2004 McDonald ..... F02C 7/04 415/151
2011/0255952 A1 10/2011 Williams et al.
2012/0315127 A1* 12/2012 Zheng ..... F04D 29/685 415/58.4
2014/0341727 A1* 11/2014 Chen ..... F04D 17/10 415/206
2015/0192133 A1 7/2015 An et al.
2015/0192147 A1 7/2015 An et al.
2015/0337863 A1* 11/2015 Tomita ..... F04D 29/4213 415/58.4
2015/0354591 A1* 12/2015 Ibaraki ..... F04D 29/441 415/147
2016/0131154 A1* 5/2016 Yang ..... F04D 29/4213 415/183
2016/0201693 A1* 7/2016 An ..... F04D 29/4213 415/58.4

FOREIGN PATENT DOCUMENTS

| | | | |
|---|---|---|---|
| EP | 1 143 149 | A2 | 10/2001 |
| EP | 2 110 557 | A1 | 10/2009 |
| JP | 58-185934 | | 10/1983 |
| JP | 2001-289197 | | 10/2001 |
| JP | 2008-208753 | | 9/2008 |
| JP | 2010-270641 | | 12/2010 |
| JP | 2012149619 | A * | 8/2012 |
| JP | 2012-184751 | | 9/2012 |
| WO | WO 2007/093367 | A1 | 8/2007 |
| WO | WO 2014/030248 | A1 | 2/2014 |
| WO | WO 2014/033878 | A1 | 3/2014 |

* cited by examiner

CENTRIFUGAL COMPRESSOR

CROSS-REFERENCES TO RELATED APPLICATIONS

This application claims the benefit of Japanese Patent Applications No. 2014-146093, filed Jul. 16, 2014, and No. 2015-078575, filed Apr. 7, 2015, which are hereby incorporated by reference wherein in their entirety.

BACKGROUND OF THE INVENTION

Field of the Invention

The present invention relates to a centrifugal compressor, and more particularly, to a centrifugal compressor applied to a turbocharger for a vehicle.

Description of the Related Art

Turbochargers are typically used as superchargers for vehicles. A turbocharger drives a turbine using the energy of the exhaust gas exhausted from the engine, drives a centrifugal compressor coaxially coupled to the turbine, compresses gas (intake air), and supercharges the engine.

In such centrifugal compressors, there is a problem in that as the gas flow volume drops, flow reversal or laminar separation is produced in the flow of gas passing through the impeller, and a surge occurs. Consequently, there is a continual demand to expand the operating range by lowering the minimum allowable flow volume at which surging does not occur, or in other words, by improving the surge limit.

To improve the surge limit, Japanese Patent Laid-Open No. 2001-289197 describes an invention related to a centrifugal compressor having a circulating casing treatment. In times of low flow volume, static pressure is used to form a circulating flow that passes through hollow portions inside the casing near the leading edge of the impeller blades. Also, to further expand the operating range, Japanese Patent Laid-Open No. 2001-289197 describes exhausting from the hollow portions a circulating flow having a swirl component in the reverse rotational direction of the impeller.

Japanese Patent Laid-Open No. 2010-270641 describes a centrifugal compressor provided with an inlet guide vane that imparts to gas a swirl component in the opposite direction of the rotational direction of the impeller, on the downstream side of the exhaust port of the casing treatment and on the upstream side of the impeller.

However, in some cases, the layout of the gas channel on the upstream side of the impeller causes the flow of gas supplied to the impeller to have a swirl component in the direction of axial rotation of the impeller. In this case, with the device disclosed in Japanese Patent Laid-Open No. 2001-289197, it may become difficult to suppress surging with a circulating flow from the casing treatment.

With the device disclosed in Japanese Patent Laid-Open No. 2010-270641, the exhaust port of the casing treatment is farther upstream than the inlet guide vane. For this reason, it is difficult to suppress surging with a circulating flow from the exhaust port of the casing treatment.

Accordingly, the present invention has been devised in light of the above circumstances, and takes as an objective to provide a centrifugal compressor having a circulating casing treatment enabling an improved surge limit.

SUMMARY OF THE INVENTION

According to an aspect of the present invention, there is provided a centrifugal compressor comprising:

an impeller;

a casing configured to rotatably house the impeller allowing rotation about a rotational axis;

a gas channel, at least provided in the casing, configured to circulate gas passing through the impeller;

a treatment hollow part provided inside the casing;

a first channel, open to the gas channel at a vicinity of and on the downstream side of a blade leading edge of the impeller, configured to introduce gas into the treatment hollow part from the gas channel;

a second channel, open to the gas channel at a position on the upstream side of the blade leading edge, configured to discharge gas inside the treatment hollow part into the gas channel;

a guide vane configured to impart a swirl component in an opposite rotational direction of the impeller to gas discharged via the second channel;

a constricting part, provided at a position on the upstream side of an opening part of the second channel, configured to constrict the gas channel to a gas channel diameter at a position of the opening part of the second channel; and a rectifying part, provided in the constricting part, and including at least one rectifying element configured to rectify gas supplied to the constricting part in a direction that minimizes a swirl component about the rotational axis and also increases a component in a direction of the rotational axis.

Accordingly, the constricting part increases the speed of gas supplied thereto, and the rectifying part is able to rectify gas supplied to the constricting part in a direction that minimizes the swirl component about the rotational axis and also increases the component in the direction of the rotational axis. As a result, gas immediately after passing through the constricting part is accelerated and made to have a comparatively strong axial component. When such gas is mixed into the circulating flow discharged from the second channel, the component in the direction of the rotational axis in the flow of the mixed gas increases, thereby enabling an improvement in the surge limit.

Preferably, the rectifying element extends parallel to the rotational axis.

Accordingly, with a simple structure, it is possible to rectify gas supplied to the constricting part in a direction that minimizes the swirl component about the rotational axis and also increases the component in the direction of the rotational axis. The rectifying element that "extends parallel to the rotational axis" referred to herein includes a rectifying element that extends in the radiation direction from the rotational axis, but also includes a rectifying element in which a rectifying element extending in such a radiation direction has a virtual line parallel to the rotational axis, and extends in a rotated direction with respect to the virtual line on the rectifying element.

Preferably, the rectifying element includes a rectifying plate, and the rectifying plate includes an inner circumferential edge positioned at the same radial position as an outer circumferential edge of the blade leading edge, or a position farther outward in the radial direction.

Accordingly, when viewed from the upstream side in the direction of the rotational axis, the rectifying plate does not project out into the trailing gas channel leading up to the blade leading edge, and intake resistance may be decreased when the impeller sucks up gas.

Preferably, the rectifying plate extends along a radial direction centered on the rotational axis.

Accordingly, a greater effect of improving the surge limit is obtained compared to the case in which the rectifying plate does not extend along the radial direction.

The centrifugal compressor may additionally include an inlet pipe connected to an inlet part of the casing. In this case, the gas channel preferably includes a gas channel inside the inlet pipe, and the constricting part is provided in the inlet pipe.

Accordingly, and similarly to the above, by increasing the component in the direction of the rotational axis in the mixed gas, an improvement in the surge limit becomes possible.

Preferably, an intake air channel connected to the upstream side of the constricting part is formed in a shape so that an intake air flow flowing into the constricting part has a swirl component about the rotational axis.

Accordingly, gas may be particularly suitably rectified by the rectifying element.

According to the present invention, there is exhibited an advantageous effect of providing a centrifugal compressor having a circulating casing treatment enabling an improved surge limit.

Further features of the present invention will become apparent from the following description of exemplary embodiments (with reference to the attached drawings).

DESCRIPTION OF THE EMBODIMENTS

Hereinafter, exemplary embodiments of the present invention will be described on the basis of the attached drawings.

First Embodiment

Figure 1:
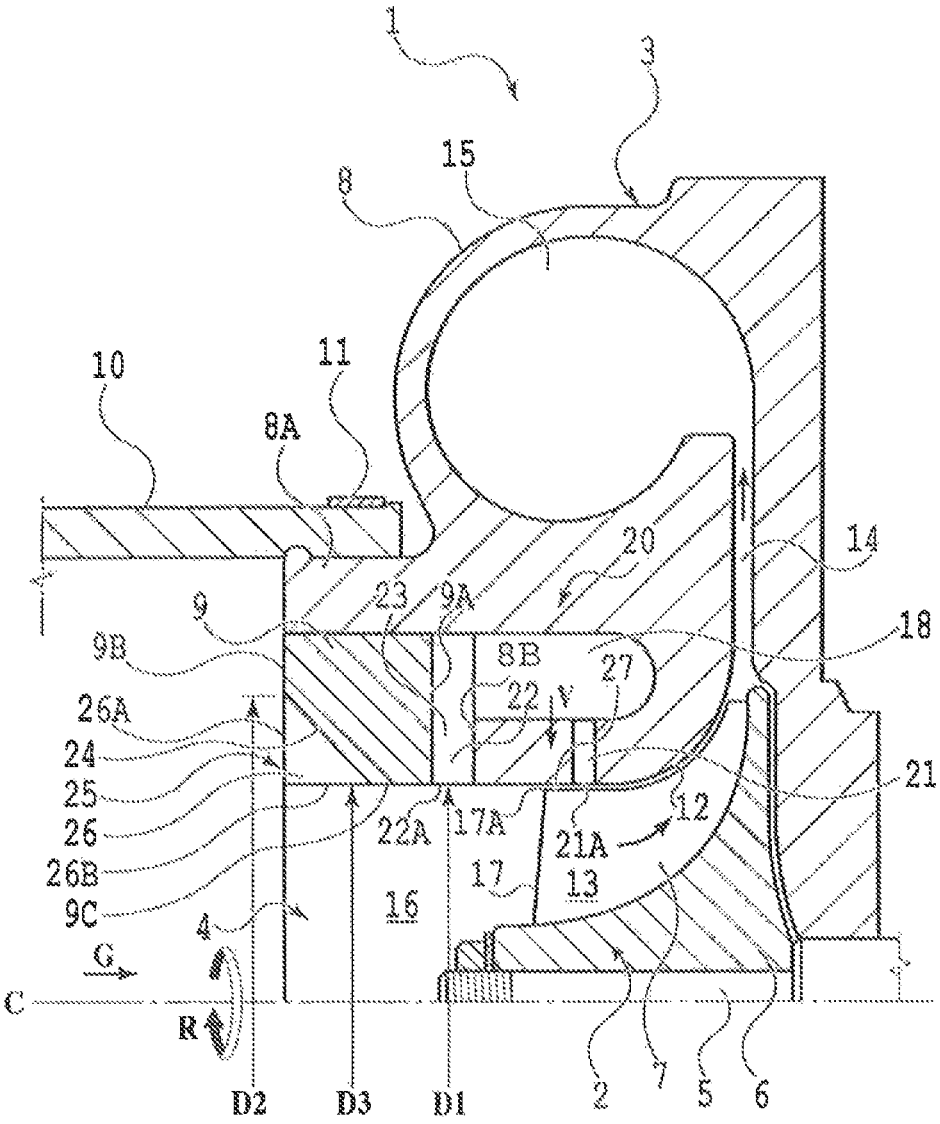
FIG. 1 is a lateral cross-section view of a centrifugal compressor according to a first embodiment of the present invention.

FIG. 1 illustrates a centrifugal compressor 1 according to a first embodiment of the present invention. The centrifugal compressor 1 is applied as the compressor of a turbocharger installed in an internal combustion engine for a vehicle (particularly for an automobile), and is equipped with an exhaust gas turbine coaxially coupled to the centrifugal compressor 1 on the right, outside the range of the drawing. However, the usage of the centrifugal compressor 1 is arbitrary.

As illustrated in the drawing, the centrifugal compressor 1 is provided with an impeller 2, a casing 3 that rotatably houses the impeller 2 allowing rotation about a rotational axis C, and a gas channel 4, at least provided in the casing 3, for circulating gas G (in the present embodiment, intake air of the internal combustion engine) passing through the impeller 2 as indicated by the arrow. The impeller 2 is affixed to a shaft 5 that acts as a turbine shaft, and is rotatably driven via the shaft 5 by a turbine wheel on the right, outside the range of the drawing. The impeller 2 includes a hub 6, and multiple blades 7 erected on the hub 6.

In the following description, unless specifically noted otherwise, the terms "axial direction", "radial direction", and "circumferential direction" are taken to refer to the axial direction, radial direction, and circumferential direction with respect to the rotational axis C. Also, the terms "upstream side" and "downstream side" are taken to refer to the upstream side and the downstream side in the flow direction of the gas G. Additionally, the upstream side and the downstream side in the axial direction may also be referred to as "front" and "rear".

In the present embodiment, the casing 3 is made up of a casing body 8, and a ring member 9 attached by being inserted into an inlet 8A of the casing body 8. On the outer circumference of the inlet 8A of the casing body 8, an inlet pipe 10 made up of rubber hose or the like is fitted and affixed with a fastening member such as a clamp band 11. From this inlet pipe 10, gas G is introduced into the gas channel 4.

The casing body 8 includes a shroud wall 12 that surrounds the impeller 2. The gap between the impeller 2 and the shroud wall 12 is minimized so that gas leaks are as little as possible. Additionally, an inter-blade channel 13 is defined by the shroud wall 12, a pair of adjacent blades 7, and the hub 6. Multiple such inter-blade channels 13 are formed, equal to the number of pairs of blades 7. In the casing body 8, on the downstream side of the impeller 2, a radial direction channel 14 and an adjoining scroll compression chamber 15 are defined. Meanwhile, on the upstream side of the inter-blade channels 13 and thus the impeller 2, an inlet channel 16 extending in the axial direction is defined. The gas channel 4 is formed by the inlet channel 16, the inter-blade channel 13, the radial direction channel 14, and the scroll compression chamber 15.

During operation, as in the related art, when the impeller 2 is rotated, gas G flows into the inter-blade channels 13 via the inlet channel 16, and in the process of passing through it, flow direction is changed by 90 degrees, and after that, successively passes through the radial direction channel 14 and the scroll compression chamber 15, and is finally compressed. The compressed gas G inside the scroll compression chamber 15 is discharged from an outlet (not illustrated) to a supply destination, which in the present embodiment is a cylinder of an internal combustion engine.

Also, the centrifugal compressor 1 includes a circulating casing treatment 20 through which flows a circulating flow. As discussed in detail later, the casing treatment 20 is configured to form a circulating channel between the gas channel 4 on the upstream and downstream sides of the blade leading edge of the impeller 2, and a treatment hollow part 18 provided inside the casing 3.

The casing treatment 20 includes the treatment hollow part 18, a first channel 21, and a second channel 22. The treatment hollow part 18 is defined inside the casing body 8 at a position in the outer radial direction of the blade leading edge 17, and has a shape extending in the axial direction. The first channel 21 communicates with the treatment hollow part 18 on the rear side in the axial direction, and in addition, includes an inlet 21A opened to the gas channel 4 (inter-blade channels 13) at a vicinity of and downstream to the blade leading edge 17, so that gas G is introduced into the treatment hollow part 18 from the gas channel 4. The second channel 22 communicates with the treatment hollow part 18 on the front side in the axial direction, and in addition, includes an outlet 22A opened to the gas channel 4 (inlet channel 16) at a vicinity of and upstream to the blade leading edge 17, so that gas G is discharged from the treatment hollow part 18 into the gas channel 4.

The treatment hollow part 18 is formed in a ring shape extending in the entire circumferential direction, and similarly, the first channel 21 and the second channel 22 are formed in slit shapes extending in the entire circumferential direction. Alternatively, the first channel 21 and the second channel 22 may also be formed from multiple holes provided at equal intervals in the entire circumferential direction. The second channel 22 is defined by the gap between the inner circumferential front edge 8B of the casing body 8 and the rear face 9A of the ring member 9. Note that the front face of the treatment hollow part 18 is also defined by the rear face 9A of the ring member 9. The inner circumferential part of the casing body 8 positioned between the first channel 21 and the second channel 22 is supported on the casing body 8 farther outward in the radial direction, by a bridging support member (not illustrated).

Figure 2:
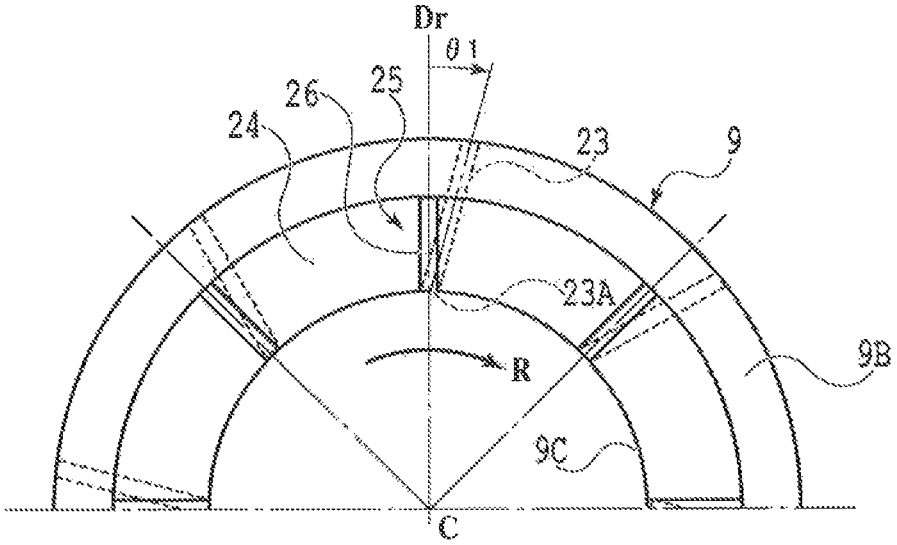
FIG. 2 is a front view of a ring member.

In addition, there is provided guide vanes 23 that impart a swirl component in the opposite rotational direction of the impeller 2 to gas G discharged via the second channel 22. As also illustrated in FIG. 2, the guide vanes 23 are plurally erected at equal intervals in the circumferential direction on the rear face 9A of the ring member 9. Additionally, each guide vane 23 is tilted by a designated tilt angle θ1 about an inner radial edge 23A of the guide vane 23, in a radial direction Dr centered about the rotational axis C. Herein, as illustrated in FIG. 2, when viewed from the upstream side in the axial direction (that is, when viewed from the front), the tilt angle is taken to be positive when tilted in a rotational direction R of the impeller 2 with respect to the radial direction Dr. By tilting the guide vanes 23 in this way, gas G inside the treatment hollow part 18 is discharged in an opposite orientation from the rotational direction R of the impeller 2, or in other words, the gas G is given a swirl component in the opposite rotational direction of the impeller 2. Herein, a "swirl" means a swirl centered on the rotational axis C.

In the present embodiment, the guide vanes 23 are formed to extend into not only the second channel 22 but also the treatment hollow part 18. In other words, the guide vanes 23 extend throughout the entire radial width of the rear face 9A of the ring member 9. According to this configuration, a swirl component may be imparted to gas G inside the treatment hollow part 18 before entering the second channel 22.

At a position on the upstream side of the opening part of the second channel 22, i.e. the outlet 22A, there is provided a constricting part 24 that constricts the gas channel 4 to a diameter D1 of the gas channel 4 at the position of the outlet 22A. Herein, a "diameter" refers to a diameter centered on the rotational axis C. The constricting part 24 is formed by cutting out a corner part formed by the front face 9B and the inner circumferential face 9C of the ring member 9, and more particularly, is formed to gradually constrict the diameter of the inlet channel 16 in a taper shape from a diameter D2 at the upstream edge of the constricting part to the diameter D1 at the downstream edge of the constricting part. Note that although the constricting part 24 has a linearly tapering cross-sectional shape as seen from the side, as illustrated in FIG. 1, the cross-sectional shape is arbitrary, and may have a curved shape as seen from the side, for example. Herein, the diameter of the inlet channel 16 is a constant D1 from the downstream edge of the constricting part to the position of the blade leading edge 17. This diameter D1 is equal to the diameter of the blade leading edge 17, or slightly larger (that is, substantially equal).

Additionally, on the constricting part 24, there is provided a rectifying part 25 that rectifies gas G supplied to the constricting part 24 in a direction parallel to the rotational axis C (in other words, in the axial direction). As also illustrated in FIG. 2, the rectifying part 25 includes rectifying plates 26 erected on the constricting part 24. The rectifying plates 26 are plurally provided at equal intervals in the circumferential direction, extending linearly along the radial direction (or parallel to the radial direction). Note that in the present embodiment, rectifying plates 26 equal to the number of guide vanes 23 (in the present embodiment, 8) are provided at the same circumferential positions, but these position and the number are arbitrarily modifiable, and may also differ from each other. "Along the radial direction" refers to not only the case of lying completely along the same direction as the radial direction, but also the case of lying substantially along the same direction as the radial direction.

As illustrated in FIG. 1, the rectifying plate 26 has a triangular shape as seen from the cross-section parallel to the rotational axis C (in other words, as seen from the side), and includes a leading edge 26A extending in the radial direction at the axial position of the front face 9B of the ring member 9, and an inner circumferential edge 26B extending in the axial direction at the radial position of the inner circumferential face 9C of the ring member 9.

The rectifying plate 26 preferably includes an inner circumferential edge 26B positioned at the same radial position as the outer circumferential edge 17A of the blade leading edge 17, or a position farther outward in the radial direction. Herein, the radial position of the outer circumferential edge 17A of the blade leading edge 17 is a position distant from the rotational axis C in the radial direction by ½ the diameter (taken to be D1 for convenience) of the blade leading edge 17 (in other words, at a radial position of D½). In the present embodiment, the inner circumferential edge 26B of the rectifying plate 26 is positioned at a radial position of D½, and also extends in the axial direction at the radial position of D½. Consequently, when viewed from the upstream side in the axial direction as illustrated in FIG. 2 (when seen from the front) the rectifying plates 26 do not project inward into a virtual circle having the diameter D1 of the blade leading edges 17. Such a virtual circle is not illustrated individually, but in the present embodiment, is positioned on the inner circumferential face 9C of the ring member 9 as illustrated in FIG. 2.

Next, the operational advantages of the first embodiment configured as above will be described. The centrifugal compressor 1 is connected to an intake channel (not illustrated) via the inlet pipe 10. The intake channel includes an air cleaner and an air flow meter as well-known. Intake air flow that flows into the gas channel 4 has a clockwise swirl component as seen in the direction of the rotational axis C from the upstream side. One reason why intake air flow that flows into the gas channel 4 has a swirl component in this way is because, for example, the intake channel curves partway through in at least two directions that do not lie mutually on the same plane, but the cause is not limited thereto. The intake air channel connected to the upstream side of the constricting part 24 is formed in a shape so that the intake air flow that flows into the constricting part 24 has a swirl component about the rotational axis C.

In the centrifugal compressor 1, there is a problem in that as the gas flow volume drops to near the surge limit, flow reversal or laminar separation is produced in the flow of gas G passing through the impeller 2, and ultimately a surge occurs. Consequently, there is a continual demand to expand the operating range by lowering the minimum allowable flow volume at which surging does not occur, or in other words, by improving the surge limit.

Figure 3:
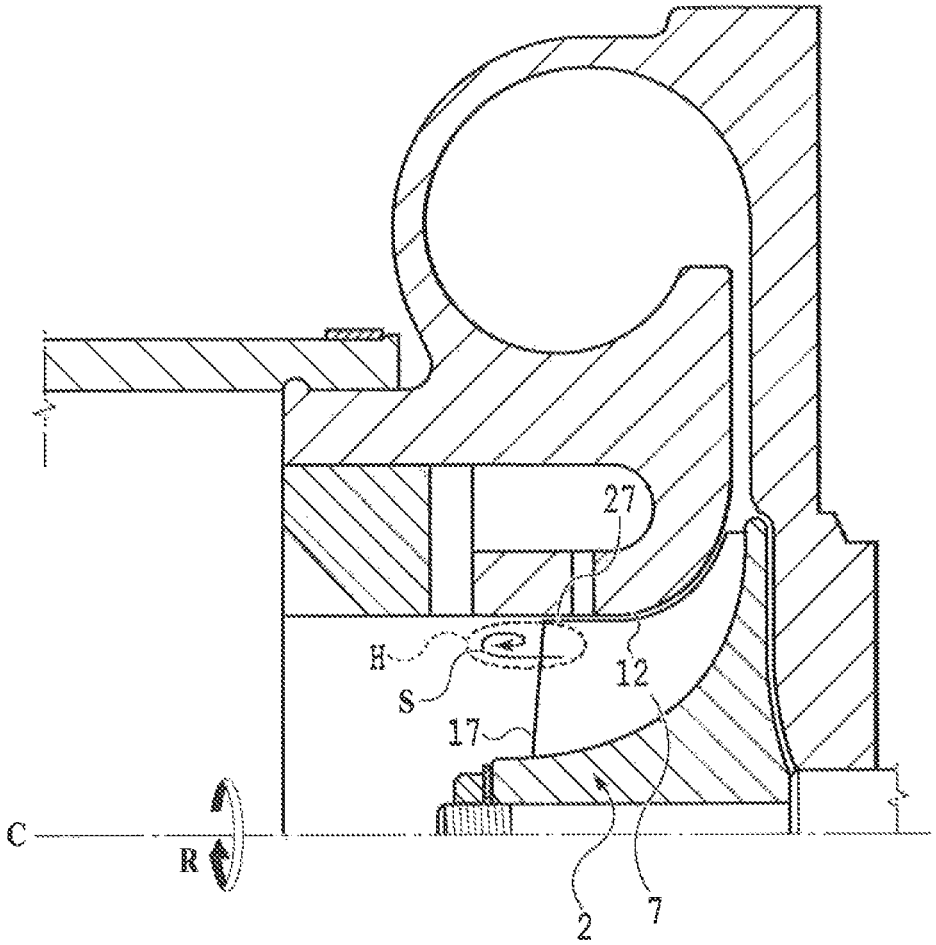
FIG. 3 is a lateral cross-section view illustrating a stall cell.

As illustrated in FIG. 3, in a low flow volume region near the surge limit, there is a tendency for at least one of flow reversal and laminar separation to occur as indicated by the arrow S. This region, enclosed by a dashed line, in which at least one of flow reversal and laminar separation occurs, is referred to as a stall cell, and is labeled H in the drawing. The stall cell H tends to occur near the blade leading edge 17 and near the blade outer circumferential edge 27 (near the shroud wall 12). The stall cell H swirls about the rotational axis C, in the rotational direction R of the impeller 2.

In such a low flow volume region, as the gas flow volume drops, there is a tendency for the stall cell H to extend in the axial direction to the front, or in other words, to grow. To improve the surge limit, it is necessary to minimize such growth of the stall cell H.

Figure 4:
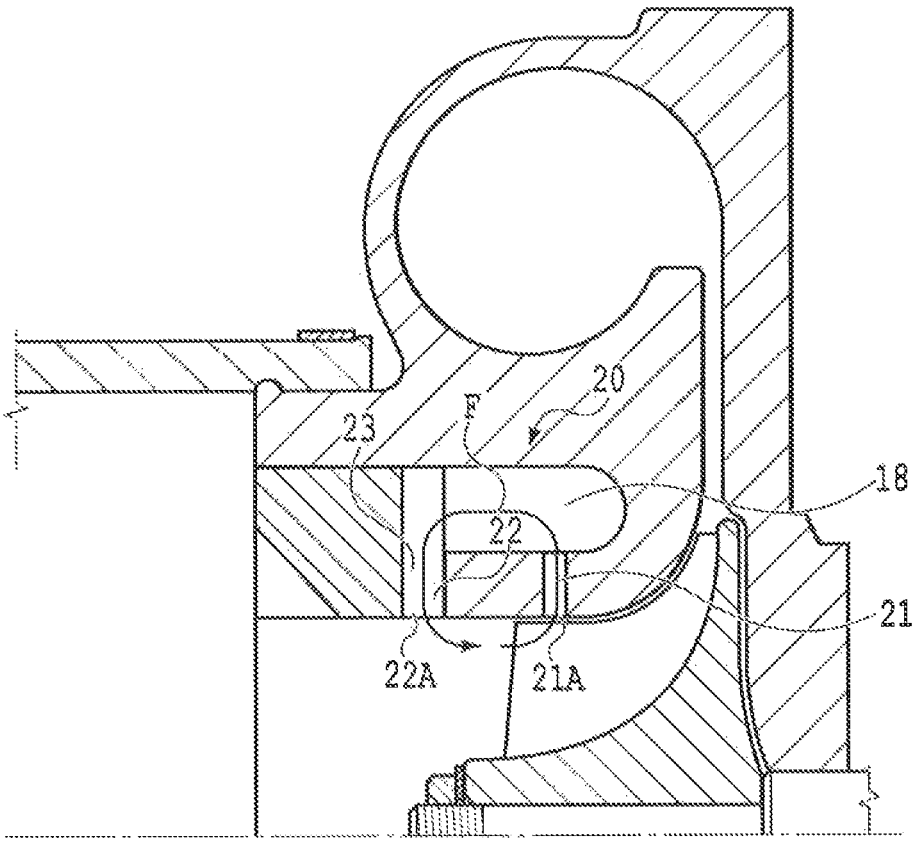
FIG. 4 is a lateral cross-section view illustrating a circulating flow generated by a casing treatment.
Figure 5:
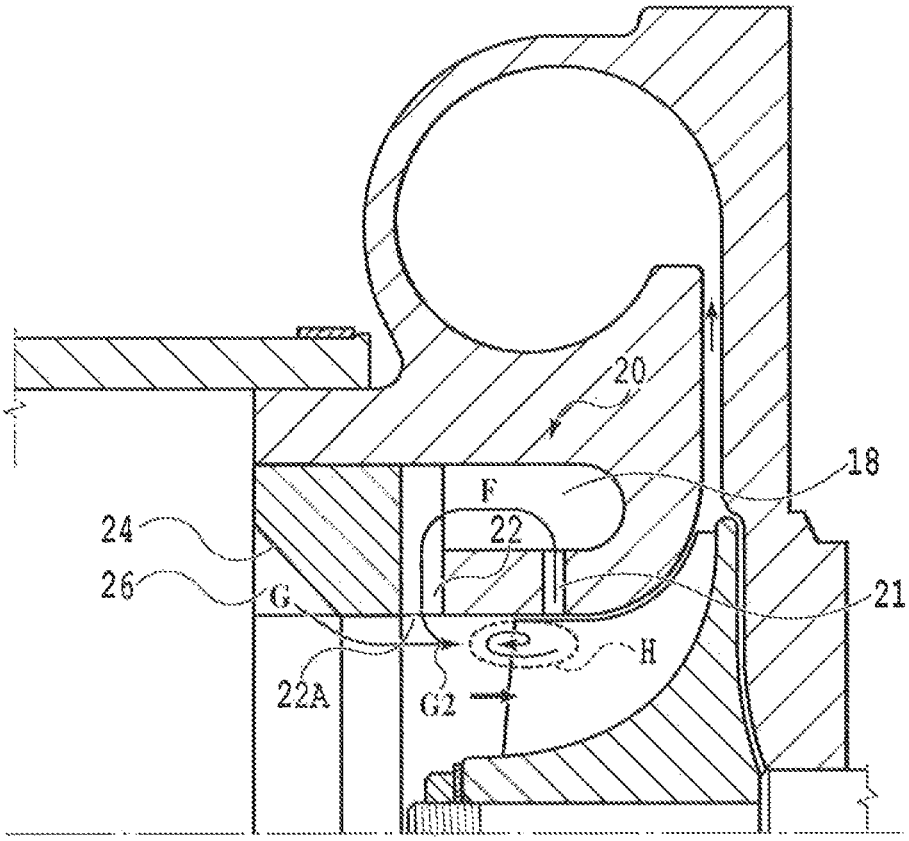
FIG. 5 is a lateral cross-section view illustrating operational advantages of an embodiment.

The circulating casing treatment 20 discussed earlier is effective at improving the surge limit. According to the casing treatment 20, in such a low flow volume region, a circulating flow F may be formed as illustrated in FIG. 4. In other words, gas introduced from the inlet 21A is introduced into the treatment hollow part 18 via the first channel 21, and after being moved to the front inside the treatment hollow part 18, is discharged from the outlet 22A via the second channel 22, sent again through the gas channel 4 to the rear, and is reintroduced from the inlet 21A, thus forming a flow of gas.

Consequently, the gas flow volume and the gas flow rate in the forward flow direction may be increased in the region near the blade outer circumferential edge 27 along the axial section from the blade leading edge 17 to the inlet 21A of the first channel 21 where the stall cell H grows readily. Thus, growth of the stall cell H may be minimized, and the surge limit may be improved. Particularly, in the present embodiment, since the guide vanes 23 impart a swirl component in the opposite rotational direction of the impeller 2 to gas discharged from the second channel 22, a significant improvement in the surge limit may be obtained.

In addition, in the present embodiment, the constricting part 24 increases the speed of gas supplied thereto, and the rectifying part 25 is able to rectify gas supplied to the constricting part 24 in a direction that minimizes the swirl component about the rotational axis C and also increases the component in the direction of the rotational axis C.

Figure 6:
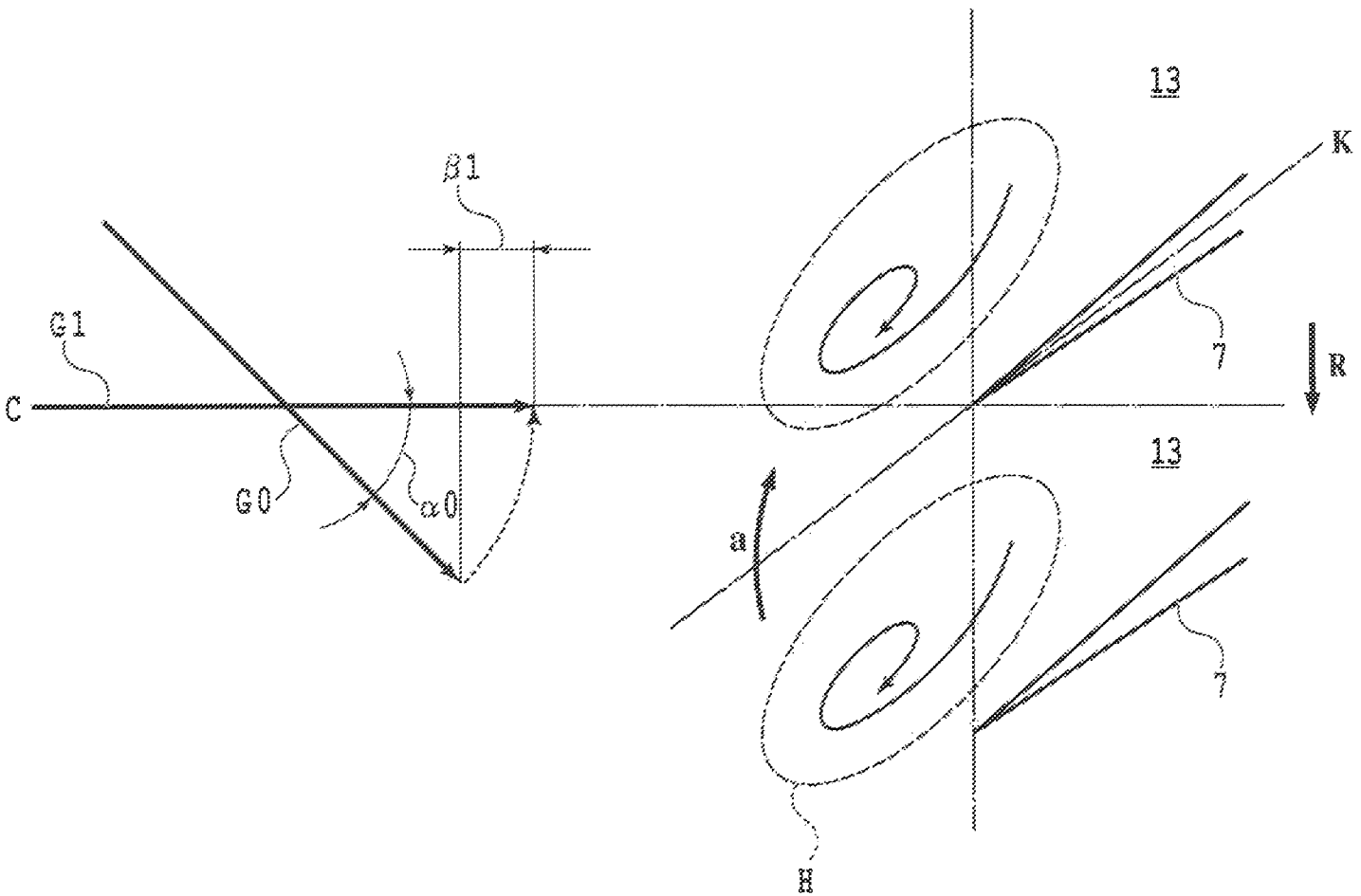
FIG. 6 is a development in the direction of the arrow V in FIG. 1.

FIG. 6 illustrates a development in the direction of the arrow V in FIG. 1 near the blade leading edge 17 (a diagram as seen from the outside looking inward in the radial direction). As illustrated in the drawing, rotation of the impeller 2 causes the blades 7 to move in the rotational direction R. As the stall cell H grows to the front, as indicated by the arrow a in the drawing, the stall cell H passes from one inter-blade channel 13 in front of the blade leading edge 17, to another inter-blade channel 13 adjacent in the opposite rotational direction, moving from one to the next. If the flow volume continues to drop, eventually all of the gas channels of the impeller 2 become covered by the stall cell H, leading to a definite surge state.

As discussed earlier, in the present embodiment, the intake channel connected on the upstream side of the centrifugal compressor 1 curves partway through in at least two directions, and as a result, the intake air flow introduced into the gas channel 4 has a clockwise swirl component as seen in the direction of the rotational axis C. In FIG. 6, assuming the hypothetical case of no rectifying part 25, the vector G0 of the flow of gas flowing into the gas channel 4 obtains an angle $\alpha 0$ with respect to the rotational axis C in the planar view, and the direction is on the same side as the rotational direction R with respect to the rotational axis C.

In contrast to this, in the present embodiment, the action of the rectifying part 25 causes the flow of gas on the downstream side of the rectifying part 25 to become parallel to the rotational axis C in the planar view, as indicated by the vector G1. In the flow of gas accelerated by the constricting part 24, the component in the direction of the rotational axis C increases by $\beta 1$ as a result of the action of the rectifying part 25, resulting in a comparatively strong axial component. This acts to push the stall cell H between the blades 7 and 7, and minimize its growth to the front. Consequently, improving the surge limit becomes possible.

In addition, even in case where the stall cell H grows to the front enough to reach the rectifying plates 26, the stall cell H is caught by the rectifying plates 26, and movement in the swirl direction is impeded. Consequently, this is also effective at minimizing movement of the stall cell H between the inter-blade channels 13.

Also, in the present embodiment, the inner circumferential edges 26B of the rectifying plates 26 are positioned at the same radial positions as the outer circumferential edges 17A of the blade leading edges 17, or positions farther outward in the radial direction. For this reason, the rectifying plates 26 do not project out into the trailing inlet channel 16, and intake resistance may be decreased when the impeller 2 sucks up gas.

Figure 7:
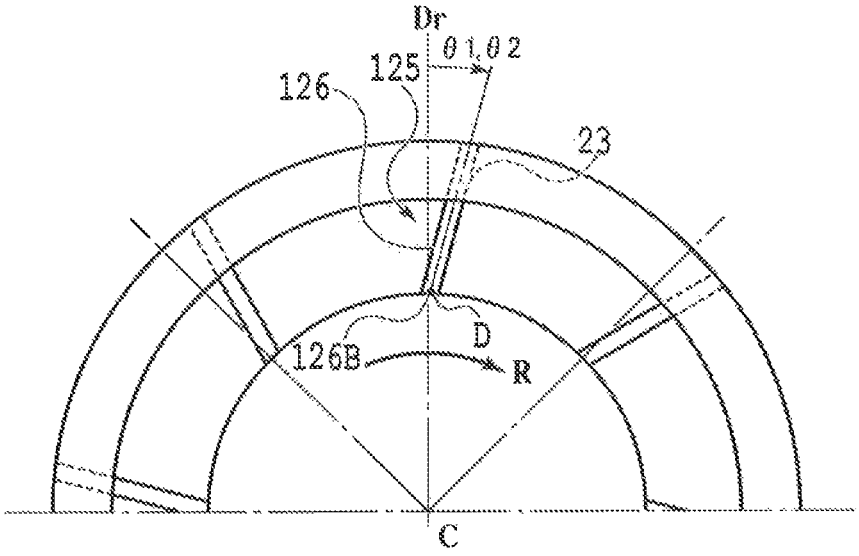
FIG. 7 is a front view of a ring member according to a first variant of the first embodiment.

Hereinafter, variant examples of the present embodiment will be described. The rectifying element according to the present invention may adopt various structures, insofar as the rectifying element rectifies gas supplied to the constricting part 24 in a direction that minimizes the swirl component about the rotational axis C and also increases the component in the direction of the rotational axis C. The first variant illustrated in FIG. 7 differs from the basic example discussed earlier in that, in the front view, rectifying plates 126 are tilted in a positive tilt angle $\theta 2$ centered on the inner circumferential edge 126B, in the rotational direction R of the impeller 2 with respect to the radial direction Dr, thereby enabling the rectifying plate 126 to impart to gas a swirl component in the opposite rotational direction. Note that although herein the tilt angle $\theta 2$ of the rectifying plate 126 is set equal to the tilt angle $\theta 1$ of the guide vane 23, these angles may also be different. The rectifying plate 126 extends parallel to the rotational axis C. Provided that the rectifying plate 26 extending in the radiation direction in the first embodiment discussed earlier has a virtual line D parallel to the rotational axis C, the rectifying plate 126 extends in a rotated direction with respect to the virtual line D on the rectifying plate 26. The virtual line D may be provided at an arbitrary position on the rectifying plate 26.

Figure 8:
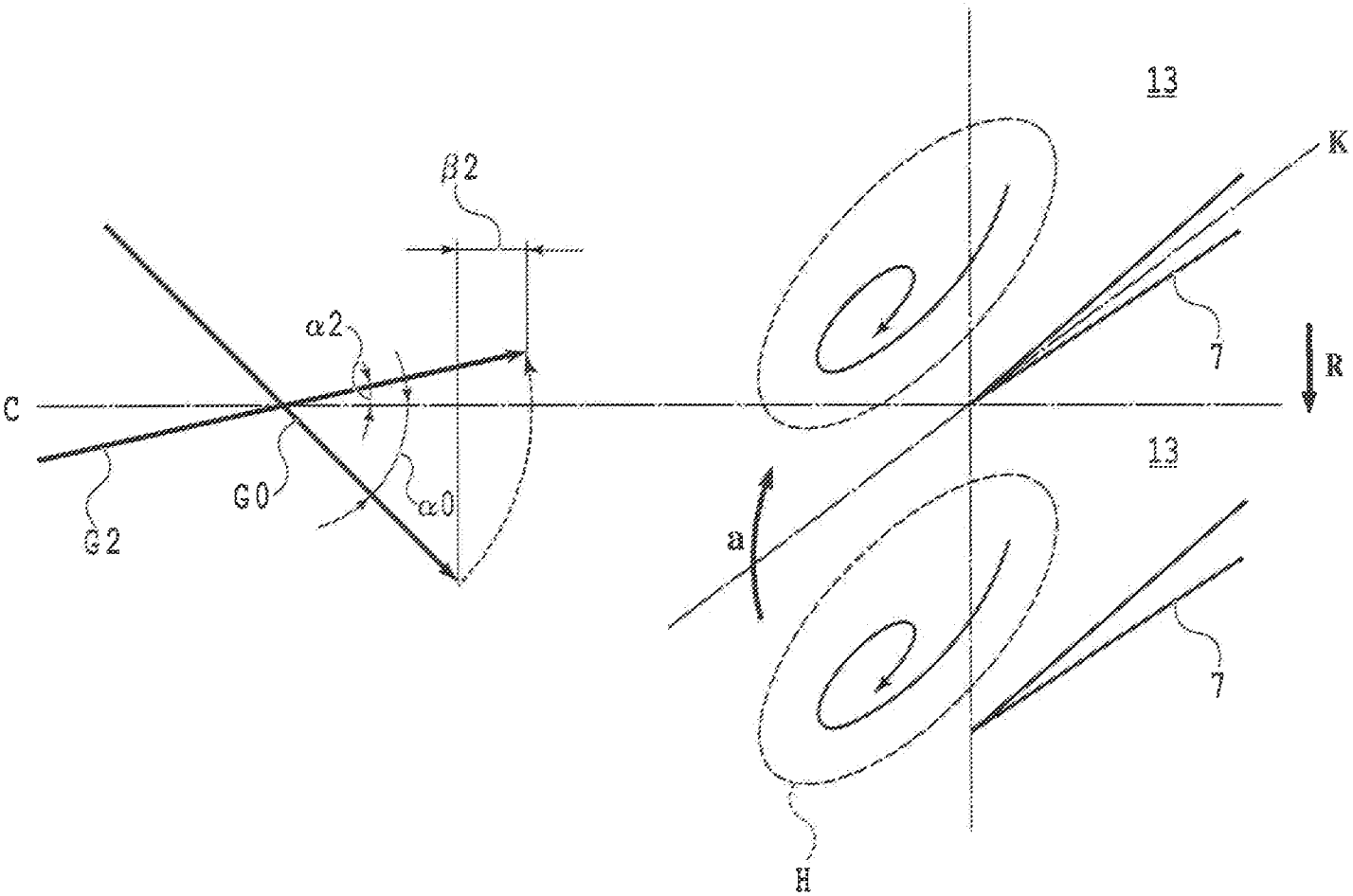
FIG. 8 is a development in the direction of the arrow V in FIG. 1 for the first variant.

As illustrated in FIG. 8, the action of the rectifying part 125 causes the flow of gas on the downstream side of the rectifying part 125 to obtain an angle $\alpha 2$ with respect to the rotational axis C in the planar view as indicated by the vector G2, where the angle $\alpha 2$ is less than the angle $\alpha 0$. As a result of the action of the rectifying part 125, gas immediately after passing through the constricting part 24 is accelerated and made to have a comparatively strong axial component. This acts to increase the component of the flow of gas in the direction of the rotational axis C by $\beta 2$, push the stall cell H between the blades 7 and 7, and minimize its growth to the front. Consequently, improving the surge limit becomes possible.

Figure 9:
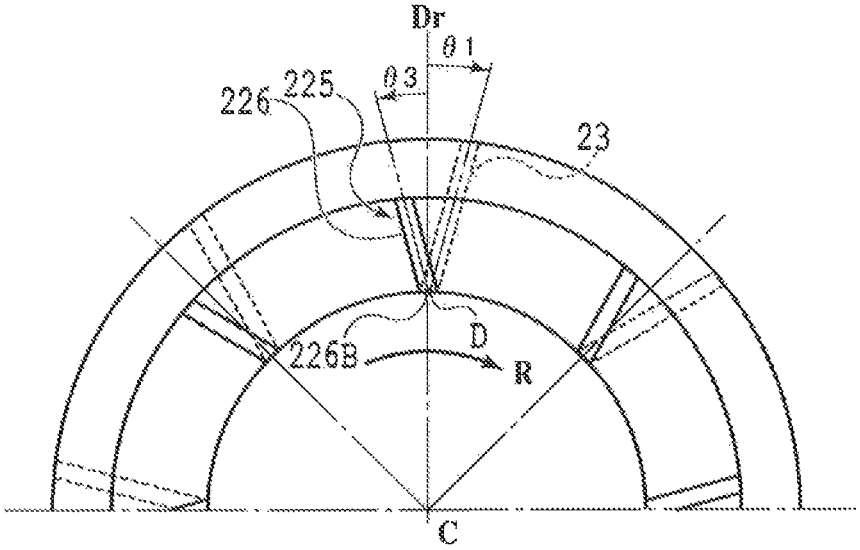
FIG. 9 is a front view of a ring member according to a second variant of the first embodiment.

The second variant illustrated in FIG. 9 differs from the basic example discussed earlier in that, in the front view, rectifying plates 226 are tilted in a negative angle $\theta 3$ centered on the inner circumferential edges 226B, in the opposite rotational direction of the impeller 2 with respect to the radial direction Dr, thereby enabling the rectifying plates 226 to impart to gas a swirl component in the rotational direction R. The rectifying plates 226 extend parallel to the rotational axis C. Provided that the rectifying plate 26 extending in the radiation direction in the first embodiment discussed earlier has a virtual line D parallel to the rotational axis C, the rectifying plate 226 extends in a rotated direction with respect to the virtual line D on the rectifying plate 26. The virtual line D may be provided at an arbitrary position on the rectifying plate 26.

Figure 10:
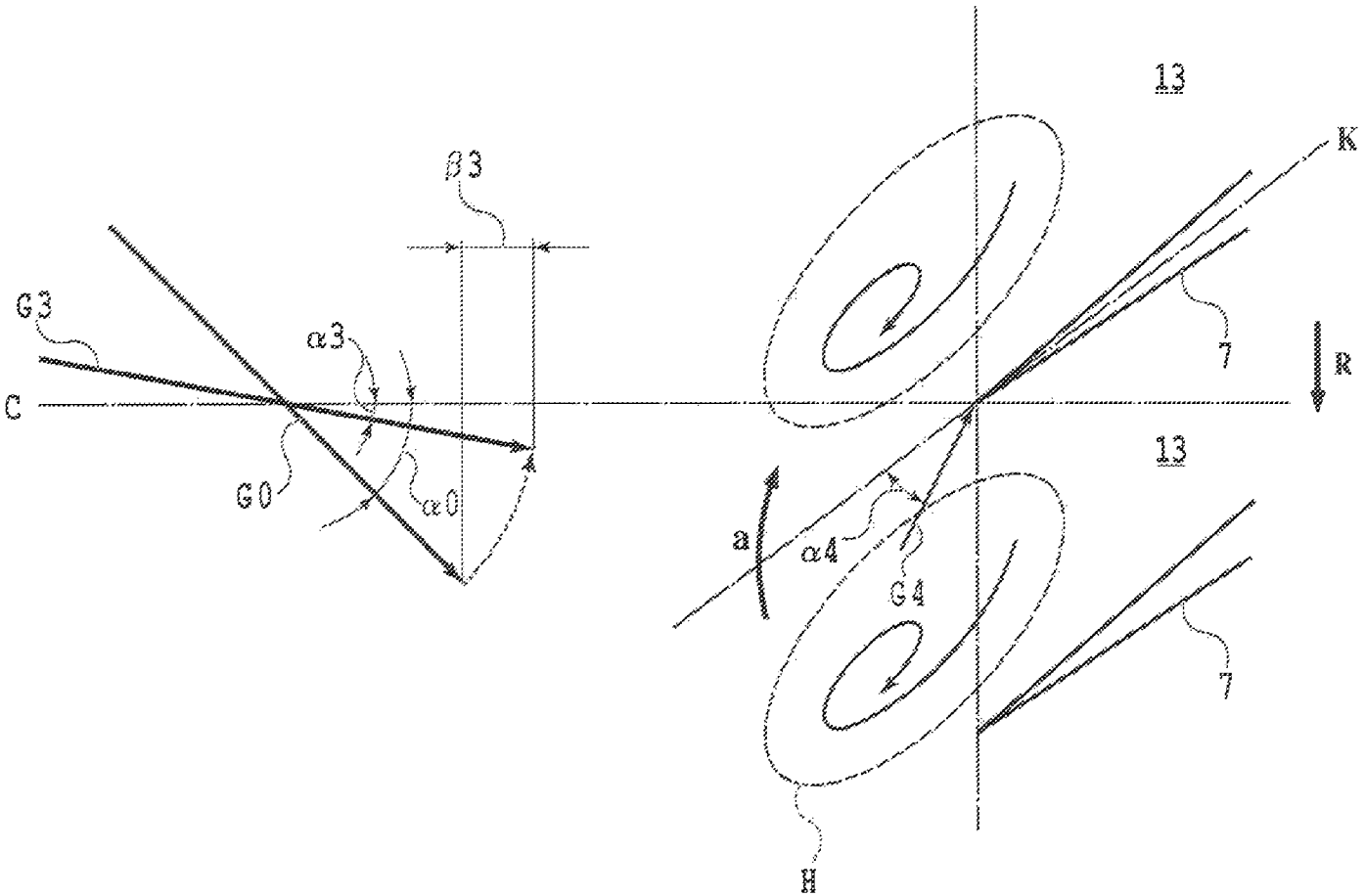
FIG. 10 is a development in the direction of the arrow V in FIG. 1 for the second variant.

As illustrated in FIG. 10, the action of the rectifying part 225 causes the flow of gas on the downstream side of the rectifying part 225 to obtain an angle $\alpha 3$ with respect to the rotational axis C in the planar view as indicated by the vector G3, where the angle $\alpha 3$ is less than the angle $\alpha 0$. In other words, the rectifying part 225 rectifies gas in the same direction as the swirl component of the intake air flow caused by the curving of the intake channel, but minimizes the swirl component of the intake air flow. As a result of the action of the rectifying part 225, gas immediately after passing through the constricting part 24 is accelerated and made to have a comparatively strong axial component. This acts to increase the component of the flow of gas in the direction of the rotational axis C by $\beta 3$, push the stall cell H between the blades 7 and 7, and minimize its growth to the front. Consequently, improving the surge limit becomes possible.

Figure 11:
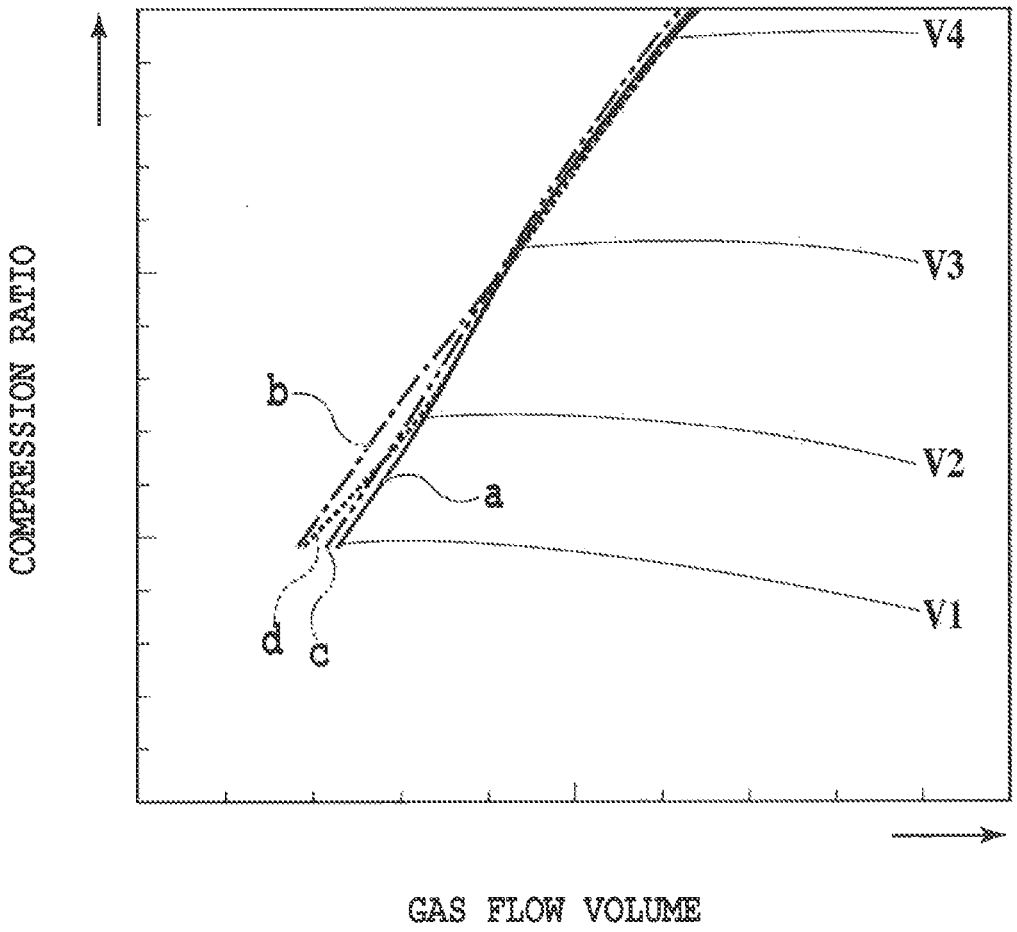
FIG. 11 is a graph illustrating a compressor map obtained as an experimental result.

FIG. 11 illustrates a compressor map obtained as an experimental result. V1 to V4 indicate lines of equal rotation, in which the rotational speed of the centrifugal compressor rises going from V1 to V4.

FIG. 11 illustrates respective surge limits (surge lines), in which the solid line a represents the case of no rectifying part, the one-dot chain line b represents the case of the basic example, the two-dot chain line c represents the first variant, and the dotted line d represents the second variant. As illustrated in the drawing, in any of the cases of the basic example, the first variant, and the second variant, the surge limit may be moved to a lower flow volume and the surge limit may be improved over the case of no rectifying part. In particular, in the basic example, the surge limit is at a lower flow volume than the first variant and the second variant, and exhibits the greatest effect of improving the surge limit. Consequently, the basic example is particularly effective at improving the surge limit. Note that when the first variant and the second variant are compared, the second variant exhibits a slightly greater effect of improving the surge line. The reason for this is not strictly clear, but whereas the circulating flow obtained by the casing treatment 20 and the guide vane 23 is in the opposite direction of the rotational direction R, the rectifying direction in the second variant is in the same direction as the rotational direction R, thereby causing the incidence angle (the angle of deviation between the orientation of the flow of gas and the orientation of the blades) $\alpha 4$ (FIG. 10) to decrease, and conceivably contributing an effect in some form.

Next, another embodiment of the present invention will be described. Note that parts similar to the first embodiment will be denoted with the same signs in the drawings and omitted from the description, and hereinafter the differences will be described primarily.

Second Embodiment

Figure 12:
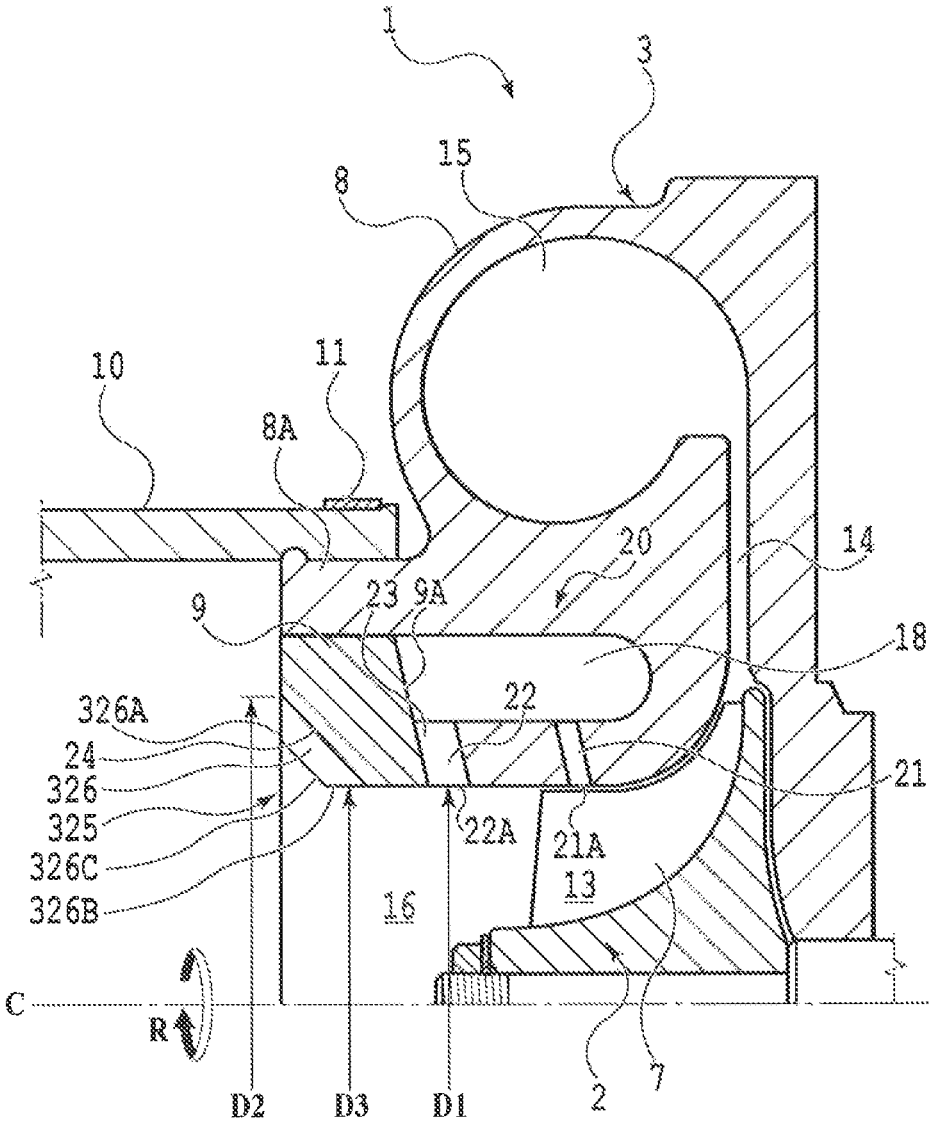
FIG. 12 is a lateral cross-section view according to a second embodiment.

In the second embodiment illustrated in FIG. 12, the configuration of the casing treatment 20 differs from the first embodiment. In other words, the first channel 21, the second channel 22, and the front edge face of the treatment hollow part 18 (the rear face 9A of the ring member 9) are tilted so that the outer radial side is positioned farther to the front than the inner radial side. As a result, an improvement in the circulation efficiency of the circulating flow F is possible.

In addition, the guide vanes 23 are shorter than in the first embodiment, and positioned only inside the second channel 22.

In addition, a corner part formed by the leading edge 326A and the inner circumferential edge 326B of each rectifying plate 326 is cut out diagonally, and a tapered part 326C is formed in each rectifying plate 326. According to the present embodiment, operational advantages similar to the first embodiment may be exhibited.

Third Embodiment

Figure 13:
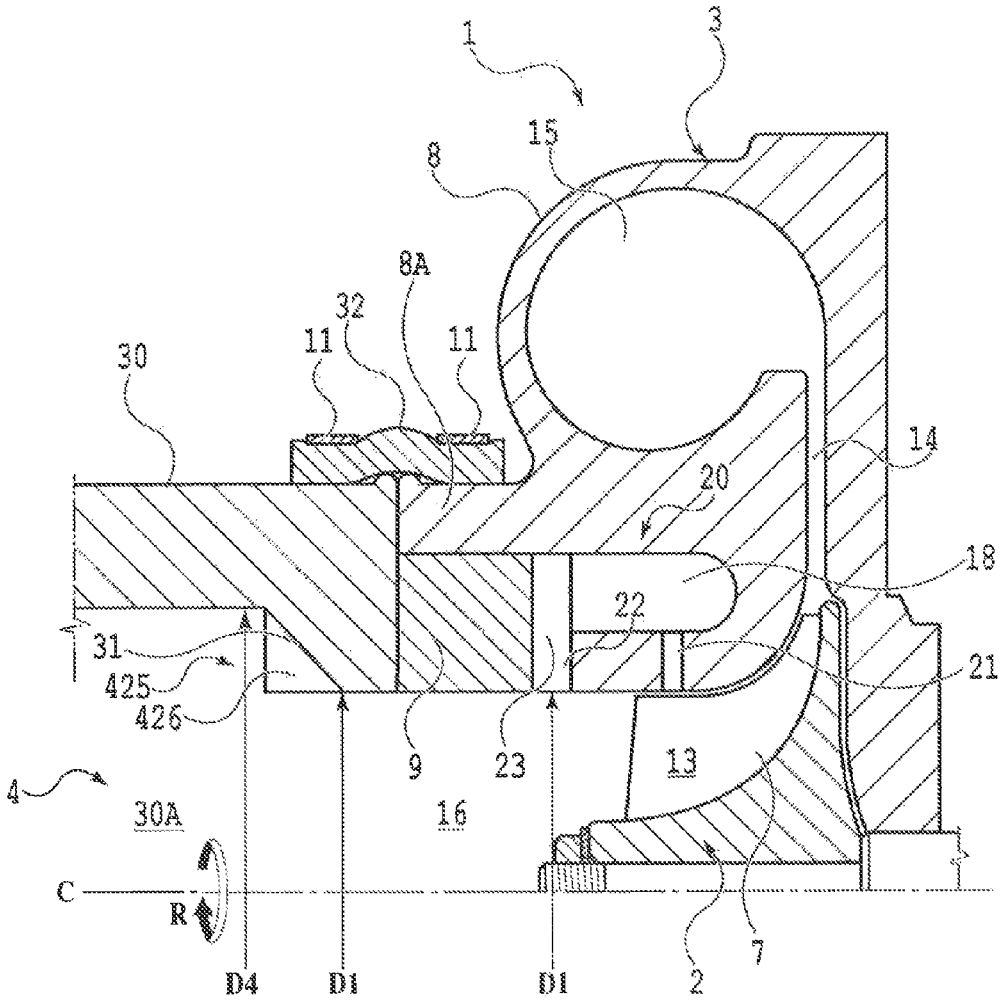
FIG. 13 is a lateral cross-section view according to a third embodiment.

In the third embodiment illustrated in FIG. 13, the installation position of the rectifying plates 426 differs from the first embodiment. In other words, an inlet pipe 30 is connected to the inlet 8A of the casing 3 (specifically, the casing body 8), a constricting part 31 is provided in the inlet pipe 30 (particularly at the trailing edge), and the rectifying plates 426 are provided in the constricting part 31. At this point, the inlet pipe 30 is abutted with the casing 3, and connected to the casing 3 by fastening both with an elastic connecting ring 32 and a clamp band 11. However, other connection methods are also possible.

The constricting part 31 is formed to gradually constrict the bore of the inlet pipe 30 in a taper shape from a diameter D4 at the upstream edge of the constricting part to the diameter D1 at the downstream edge of the constricting part. Note that the diameter of the gas channel 4 is a constant D1 from the downstream edge of the constricting part to the blade leading edge 17. A gas channel 30A inside the inlet pipe 30 neighboring on the upstream side of the inlet channel 16 is included in the gas channel 4. Additionally, the shape of each rectifying plate 426 provided in the constricting part 31 is similar to the rectifying plate 26 in the first embodiment. According to the present embodiment, operational advantages similar to the first embodiment may be exhibited. In the case of the present embodiment, the inlet pipe 30, as well as the constricting part 31 and the rectifying plate 426 provided therein, are also structural elements of the centrifugal compressor 1.

Note that since the constricting part 31 and the rectifying plate 426 are provided in the inlet pipe 30, these elements are not provided in the ring member 9, and the ring member 9 has a square cross-sectional shape.

Fourth Embodiment

Figure 14:
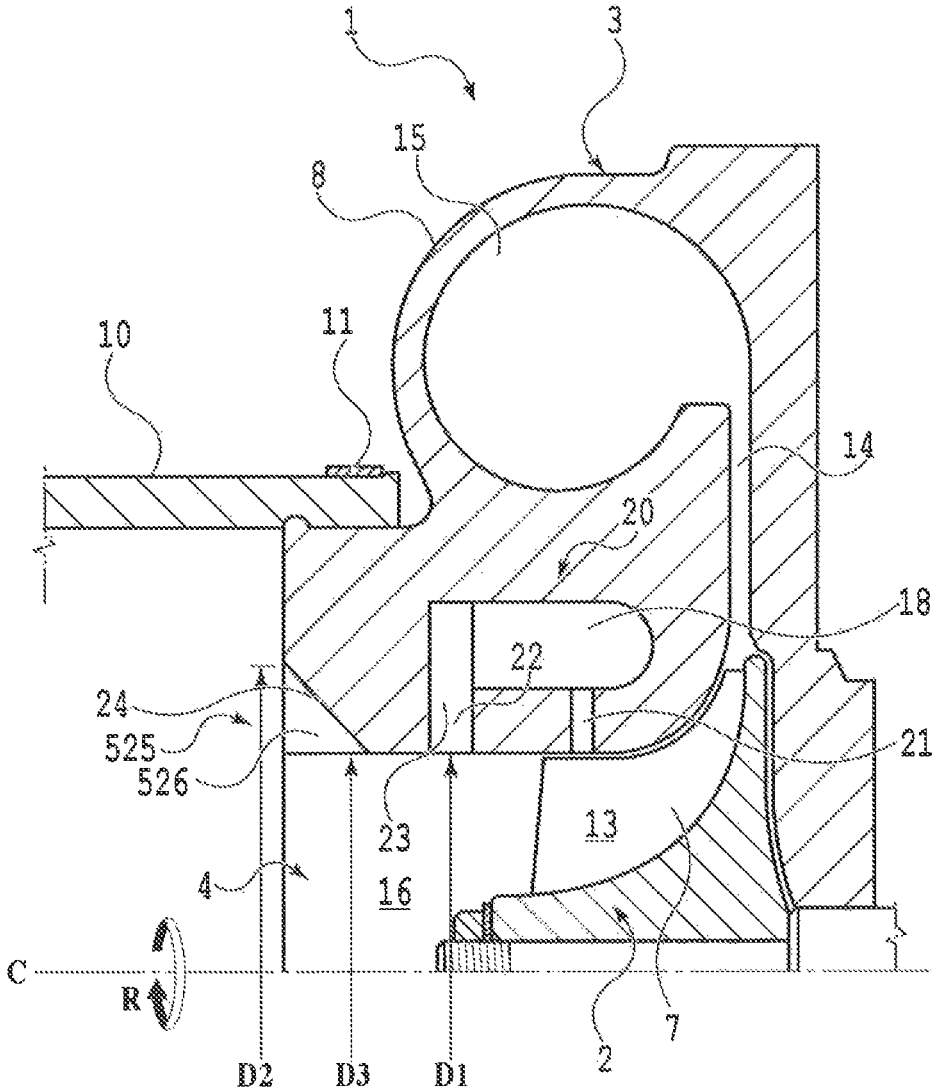
FIG. 14 is a lateral cross-section view according to a fourth embodiment.

In the fourth embodiment illustrated in FIG. 14, the ring member 9 is not provided, and the guide vane 23 and the rectifying plates 526 are provided directly on the casing body 8. The shape of each rectifying plate 526 is similar to the rectifying plate 26 in the first embodiment. Also, the treatment hollow part 18 is defined by only the casing body 8. According to this configuration, operational advantages similar to the first embodiment may be exhibited.

Fifth Embodiment

Figure 15:
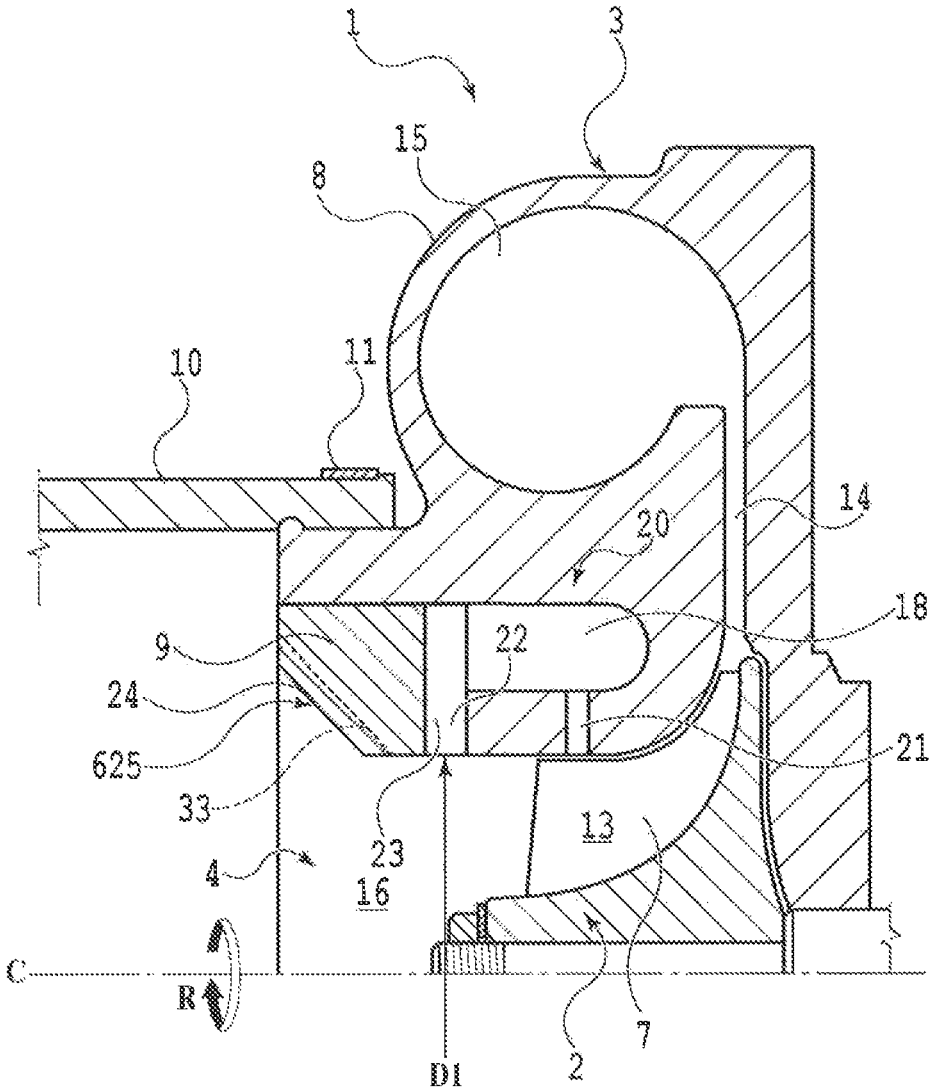
FIG. 15 is a lateral cross-section view according to a fifth embodiment.
Figure 16:
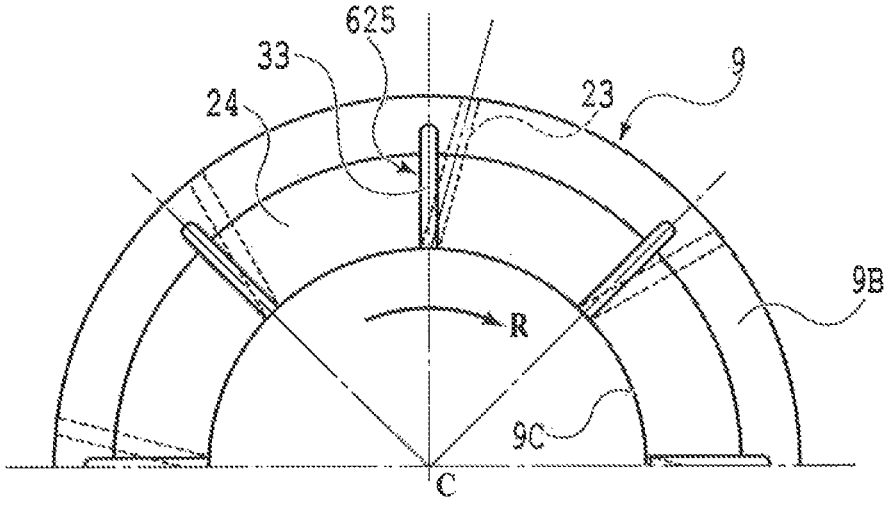
FIG. 16 is a front view of a ring member according to a fifth embodiment.

The fifth embodiment illustrated in FIGS. 15 and 16 differs from the first embodiment in that the rectifying part 625 includes rectifying grooves 33. In other words, the rectifying part 625 is formed by the rectifying grooves 33 rather than the rectifying plates 26 in the first embodiment.

The rectifying grooves 33 are provided at the same circumferential positions, in the same orientation, and in the same number as the rectifying plates 26 in the first embodiment. However, the rectifying grooves 33 may also be provided at different circumferential positions, orientations, and numbers. Each rectifying groove 33 is formed by grooving the surface of the constricting part 24 of the ring member 9. In the present embodiment, the groove width of each rectifying groove 33 is made to be the same as the thickness of the rectifying plate 26, but may also differ.

According to the rectifying grooves 33, similarly to the rectifying plates 26, gas supplied to the constricting part 24 may be rectified in the axial direction, and operational advantages similar to the first embodiment may be exhibited.

Note that the rectifying part 625 may also be configured to include both the rectifying plates 26 and the rectifying grooves 33. In this case, the numbers of rectifying plates 26 and rectifying grooves 33 may be the same or different.

The foregoing thus describes preferred embodiments of the present invention, but various other embodiments of the present invention are also possible.

(1) In the foregoing embodiments, the rectifying plates 26, 126, 226, 326, 426, and 526 as well as the rectifying grooves 33 that act as a rectifying element are all taken to have a straight shape in the front view, but the shapes of these elements are arbitrary, and a curved part may also be provided, for example. In addition, in order to increase the rectifying effect, each rectifying plate 26 may also be given a winged cross-sectional shape.

(2) The method of connecting the inlet pipe 10 to the casing 3 is also arbitrary. For example, a flange connection may also be used.

(3) In the foregoing embodiments, the intake air flow G0 flowing into the gas channel 4 uses an intake channel having a clockwise swirl component as seen in the direction of the rotational axis C, but the intake air flow G0 produced by the intake channel may also have a counter-clockwise swirl component (that is, in the opposite direction of the rotational direction R).

The foregoing embodiments, examples, and configurations may also be arbitrarily combined in non-contradictory ways. For example, the rectifying plates 326, 426, 526, as well as the rectifying grooves 33 that act as a rectifying element in the second embodiment to the fifth embodiment may also be tilted at a positive or a negative angle with respect to the radiation direction from the rotational axis C, like in the first variant and the second variant.

Any modifications, applications or their equivalents that are encompassed by the ideas of the present disclosure as stipulated by the claims are to be included in the embodiments of the present invention. Consequently, the present invention is not to be interpreted in a limited manner, and is also applicable to other arbitrary technologies belonging within the scope of the ideas of the present invention.

What is claimed is:

1. A centrifugal compressor comprising:

an impeller;

a casing configured to rotatably house the impeller allowing rotation about a rotational axis;

a gas channel, at least provided in the casing, configured to circulate gas passing through the impeller;

a treatment hollow part provided inside the casing;

a first channel, open to the gas channel at a vicinity of and on the downstream side of a blade leading edge of the impeller, configured to introduce gas into the treatment hollow part from the gas channel;

a second channel, open to the gas channel at a position on the upstream side of the blade leading edge, configured to discharge gas inside the treatment hollow part into the gas channel;

a guide vane configured to impart a swirl component in an opposite rotational direction of the impeller to gas discharged via the second channel;

a constricting part, provided at a position on the upstream side of an opening part of the second channel, configured to constrict the gas channel to a gas channel diameter at a position of the opening part of the second channel; and a rectifying part, provided in the constricting part, and including at least one rectifying element configured to rectify gas supplied to the constricting part in a direction that minimizes a swirl component about the rotational axis and also increases a component in a direction of the rotational axis.

2. The centrifugal compressor according to claim 1, wherein the rectifying element extends parallel to the rotational axis.

3. The centrifugal compressor according to claim 1, wherein the rectifying element is a rectifying plate, and the rectifying plate includes an inner circumferential edge positioned at the same radial position as an outer circumferential edge of the blade leading edge, or a position farther outward in the radial direction.

4. The centrifugal compressor according to claim 3, wherein the rectifying plate extends along a radial direction centered on the rotational axis.

5. The centrifugal compressor according to claim 3, wherein the rectifying plate has a triangular cross-sectional shape.

6. The centrifugal compressor according to claim 1, further comprising:

an inlet pipe connected to an inlet part of the casing, wherein the gas channel includes a gas channel inside the inlet pipe, and the constricting part is provided in the inlet pipe.

7. The centrifugal compressor according to claim 1, wherein an intake air channel connected to the upstream side of the constricting part is formed in a shape so that an intake air flow flowing into the constricting part has a swirl component about the rotational axis.

8. The centrifugal compressor according to claim 1, wherein the guide vane is tilted in a radial direction with respect to the rotational axis.

* * * * *